United States Patent [19]

Kvapil et al.

[11] 4,153,300

[45] May 8, 1979

[54] RECOVERY OF FLUID FUELS BY IN-SITU RETORTING OF CARBONACEOUS DEPOSITS

[75] Inventors: Rudolph Kvapil, Denver; K. Malcolm Clews, Littleton, both of Colo.

[73] Assignee: Golder Associates, Inc., Kirkland, Wash.

[21] Appl. No.: 908,797

[22] Filed: May 23, 1978

[51] Int. Cl.[2] ..... E21C 41/10

[52] U.S. Cl. ..... 299/2; 299/19

[58] Field of Search ..... 299/2, 19; 166/256, 166/259, 261

[56] References Cited

U.S. PATENT DOCUMENTS

| | | | |
|---|---|---|---|
| 3,765,722 | 10/1973 | Crumb | 299/2 |
| 3,917,347 | 11/1975 | Janssen | 299/19 X |
| 4,072,350 | 2/1978 | Bartel et al. | 299/2 |

FOREIGN PATENT DOCUMENTS

| | | | |
|---|---|---|---|
| 906938 | 2/1946 | France | 299/2 |

*Primary Examiner*—Ernest R. Purser

[57] ABSTRACT

In-situ retorts of elongated rectangular shape in horizontal cross section are constructed in subsurface carbonaceous deposits in a plurality of parallel rows in each of which the retorts are arranged end-to-end. The rows are separated by unbroken pillars extending upwardly from rock that is not undermined or penetrated by retorts or tunnels. The ceilings of the retorts slope upwardly at an angle of at least 40° with the horizontal to an apex or crown running longitudinally of the retorts to minimize the danger of roof collapse and provide a broadened pillar through which cross drifts opening into the crown of the retort extend for supplying combustion air. The crown of the ceiling is rounded to minimize concentration of the forces imposed by the overburden.

17 Claims, 4 Drawing Figures

RECOVERY OF FLUID FUELS BY IN-SITU RETORTING OF CARBONACEOUS DEPOSITS

BACKGROUND OF THE INVENTION

1. Field of the Invention

This invention relates to the recovery of fluid fuels from carbonaceous deposits and more particularly to an in-situ retort structure and a method of recovering fluid fuels from such retorts.

2. Description of the Prior Art

Immense potential sources of carbon-containing compounds suitable as fluid fuels exist in subsurface carbonaceous deposits of oil shale, coal, and heavy, highly viscous petroleum oils. The highly viscous petroleum oil deposits are frequently referred to as tar sands. Because the carbonaceous material in the deposits is either solid as in oil shale and coal or highly viscous as in tar sands, treatment of the carbonaceous deposit to make the carbon-containing compounds fluid is necessary to deliver them from the deposit to the surface. A method of treatment that has been used is to heat the deposit to a temperature at which fluid carbon-containing compounds are formed or the viscosity of heavy oils is drastically reduced. One method of heating the deposit is by in-situ combustion in which a portion of the carboniferous material in the deposit is burned in place by igniting the deposit and injecting air into the deposit to heat oil shale or tar sands to a temperature at which oils of low viscosity are produced or to produce combustible gaseous products from coal.

The very low permeability of oil shale to the flow of fluids makes it necessary to rubblize the shale to form an in-situ retort through which fluids for heating the shale to a temperature high enough to convert the kerogen to shale oil can be circulated. While sometimes coal and tar sands may be sufficiently permeable for an in-situ combustion process, rubblization of those deposits can be advantageous in reducing channeling through the deposits. One of the methods of forming an in-situ retort is described in U.S. Pat. No. 1,919,636 of Karrick. In the process described in that patent, a vertical central shaft is driven through the oil shale to provide the desired void space necessary for permeability and the oil shale is blasted from the walls of the shaft to fill the shaft with broken oil shale. Other mining procedures for forming a rubblized in-situ retort are described in U.S. Pat. No. 1,913,395 of Karrick, U.S. Pat. No. 2,481,051 of Uren, and U.S. Pat. No. 3,001,776 of Van Poolen. Those patents suggest using various mining techniques such as sublevel stoping, sublevel caving, block caving and shrinkage stoping to form the in-situ retort. In U.S. Pat. No. 3,917,347 of Janssen et al a method of constructing a retort having a cone-shaped ceiling is described.

Because of the great depth of the oil shale deposits, a substantial part of the oil shale must be left intact to support the overburden whether the shale is mined and retorted at the surface or is retorted in a modified in-situ process. If the oil shale should be mined for retorting at the surface and the full depth of the oil shale is mined, pillars having a large cross-sectional area would be necessary to support the overburden because of the great height of the pillars. In in-situ retorting processes, rubblized shale and the spent shale following retorting provide some lateral support for the pillars which would not exist in conventional mining operations. It is an object of this invention to provide an in-situ retort structure for the exploitation of a carbonaceous deposit which will provide support for the overburden and leave a minimum of unretorted carbonaceous material.

SUMMARY OF THE INVENTION

This invention resides in a process for the recovery of fluid fuels from underground carbonaceous deposits by the in-situ retorting of the carbonaceous material is rubblized retorts in the deposit. Retorts of elongated horizontal cross section are arranged end-to-end in a plurality of parallel rows. The rows are separated by side pillars over undisturbed rock structure. The upper ends of the retorts have ceilings sloping upwardly at an angle of at least 40° from each of the sides of the retorts to an apex or crown running longitudinally of the retorts to increase the width of the side pillars at their upper end to provide additional support of the overburden. The length and width of the retorts are such that virtually the entire support of the ceiling of the retorts is derived from the side pillars.

DESCRIPTION OF PREFERRED EMBODIMENT

This invention is of particular value in the production of shale oil from oil shale and for purposes of illustration will be described in detail for that use.

Figure 1:
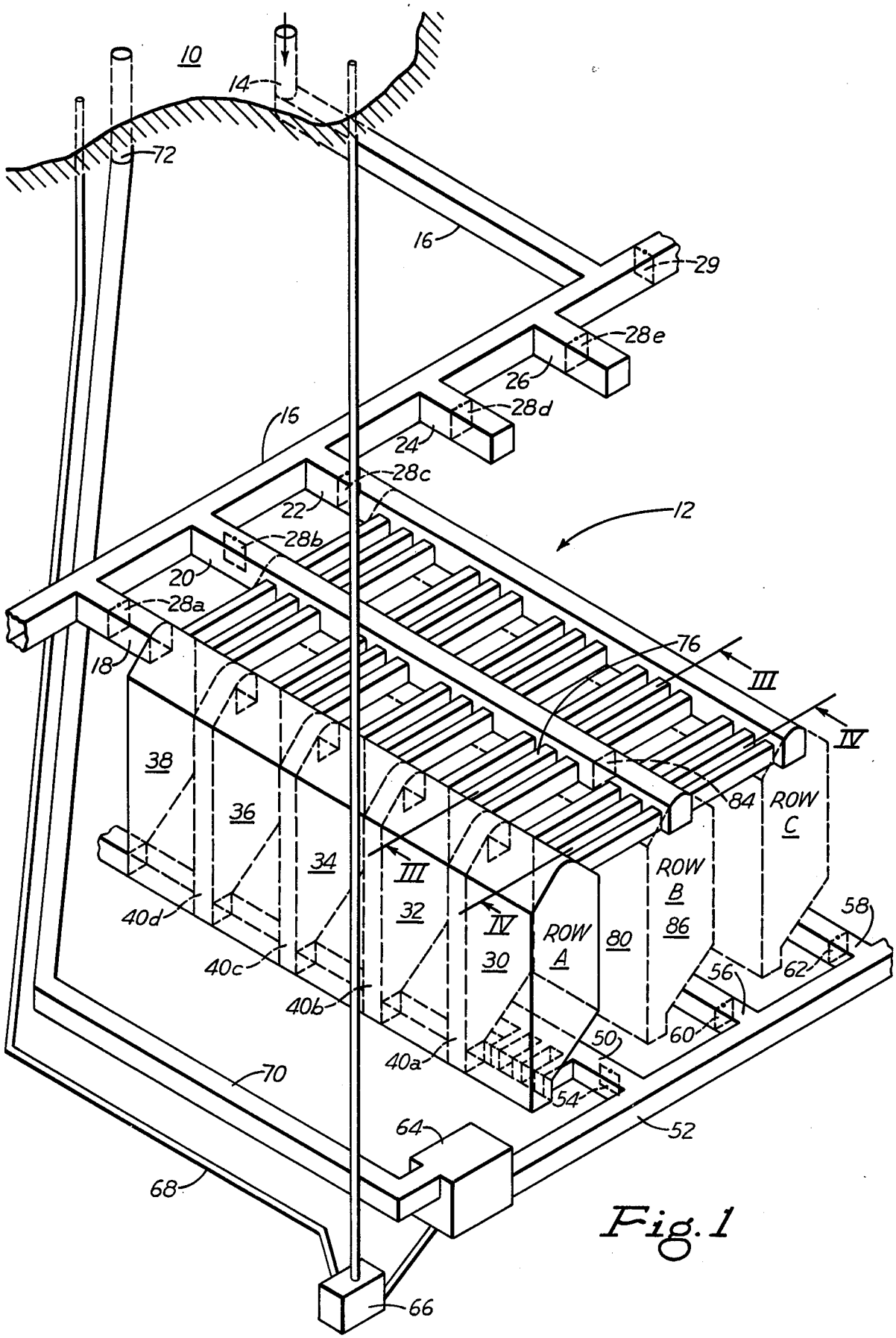
FIG. 1 is a perspective view of in-situ retorts constructed in accordance with this invention.

Referring to FIG. 1, the ground surface over a shale deposit is indicated by reference numeral 10 and parallel rows of retorts and future retorts are indicated generally by reference numeral 12. Air compression equipment, not shown in the drawings, is located on the ground surface 10 and delivers combustion air through a combustion air shaft 14 and combustion air tunnel 16 to a plurality of apex drifts 18, 20 and 22 that extend substantially perpendicularly from the tunnel 16. Collars 24 and 26 for future apex drifts are driven from the combustion air tunnel 16. Remote-controlled doors indicated by reference numerals **28*a*, 28*b*, 28*c*, 28*d* and 28*e* are installed in the apex drifts and the collars to isolate the apex drifts from the combustion air tunnel 16, as hereinafter described, before combustion air is delivered into the combustion air tunnel. A remote-controlled door 29 may be installed in the combustion tunnel to isolate a portion of the tunnel to allow combustion to be initiated before all apex drifts that will be eventually supplied with combustion air from tunnel 16 downstream of door 29** are constructed.

Figure 2:
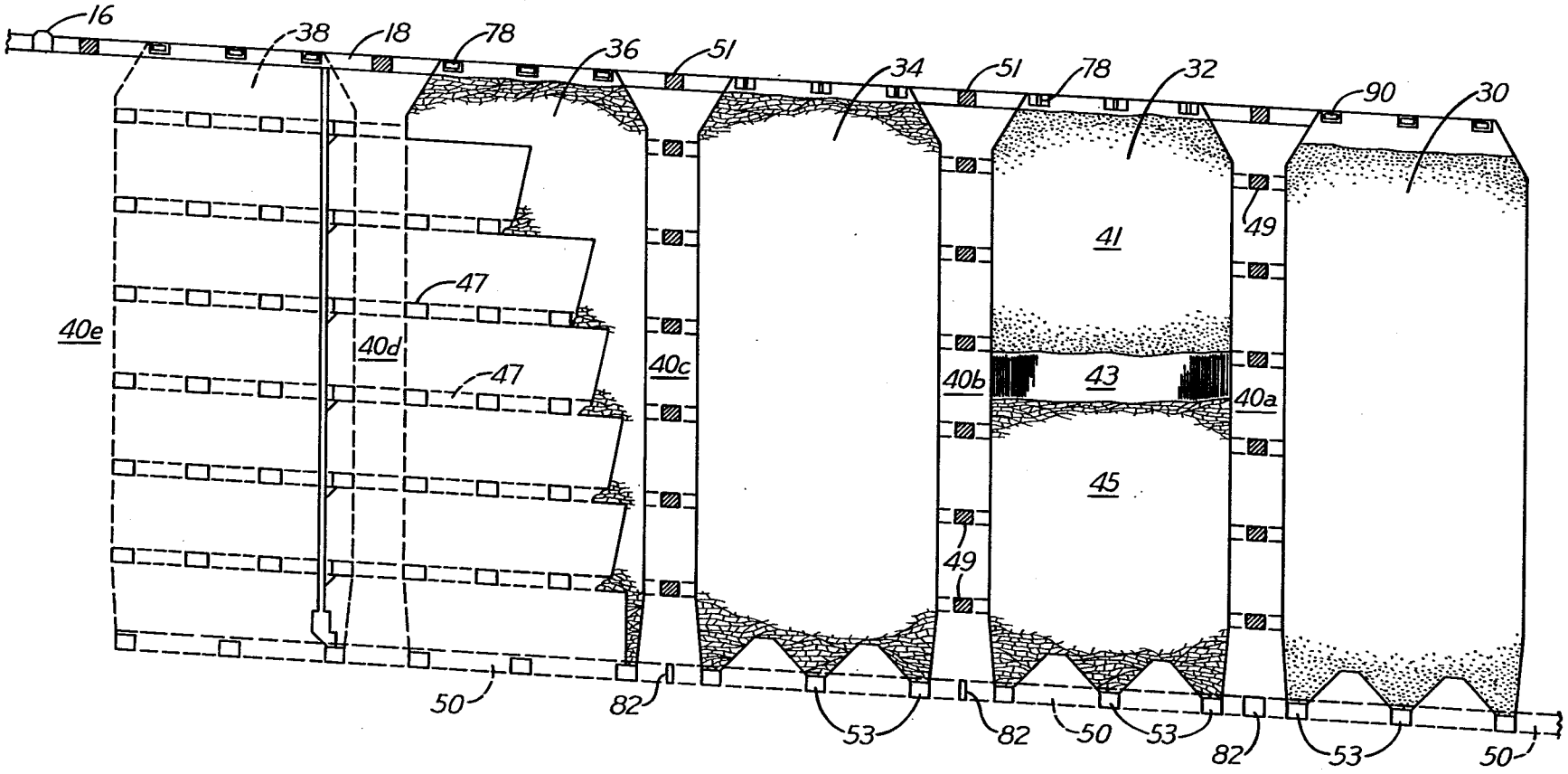
FIG. 2 is a longitudinal vertical sectional view through one of the rows of retorts.

A row A of retorts in various stages of preparation and combustion as is best shown in FIG. 2 extends downwardly below the apex drift 18 which serves as the crown of the retorts. Row A includes retorts 30, 32, 34, 36 and 38 separated by end pillars **40*a*, 40*b*, 40*c* and 40*d*. Row B and row C of future retorts parallel to row A are shown in FIG. 1. Retorts in row B will extend downwardly from apex drift 20 and retorts in row C from apex drift 22**. The retorts are rectangular in horizontal cross section and arranged in the row in end-to-end position.

As shown in FIG. 2, retort 30 has been rubblized and completely retorted to leave only spent shale in the retort. Retort 32 is in the process of being retorted with a spent shale zone 41 overlying a combustion zone 43. Below the combustion zone 43 is a retorting zone 45 which contains partially retorted shale at its upper end gradually graded to unretorted rubblized shale at the lower end of the retort. Retort 34 contains rubblized shale while retorts 36 and 38 contain shale that is being rubblized and prepared for rubblization, respectively. A plurality of mining drifts 47 useful in the rubblization of the oil shale in the retorts extends through the retorts. The mining drifts 47 that extend through the end pillars 40*a*, 40*b*, 40*c*, 40*d* and 40*e* are suitably sealed as indicated by seals 49 after rubblization is completed. Rubblization can be accomplished by any of the methods suggested in the Van Poollen, Uren, and Karrick patents. Sublevel caving is a preferred method. The rubblization results in a void space in the range of 10 to 30 percent that imparts the desired permeability to the oil shale in the retort.

Figure 3:
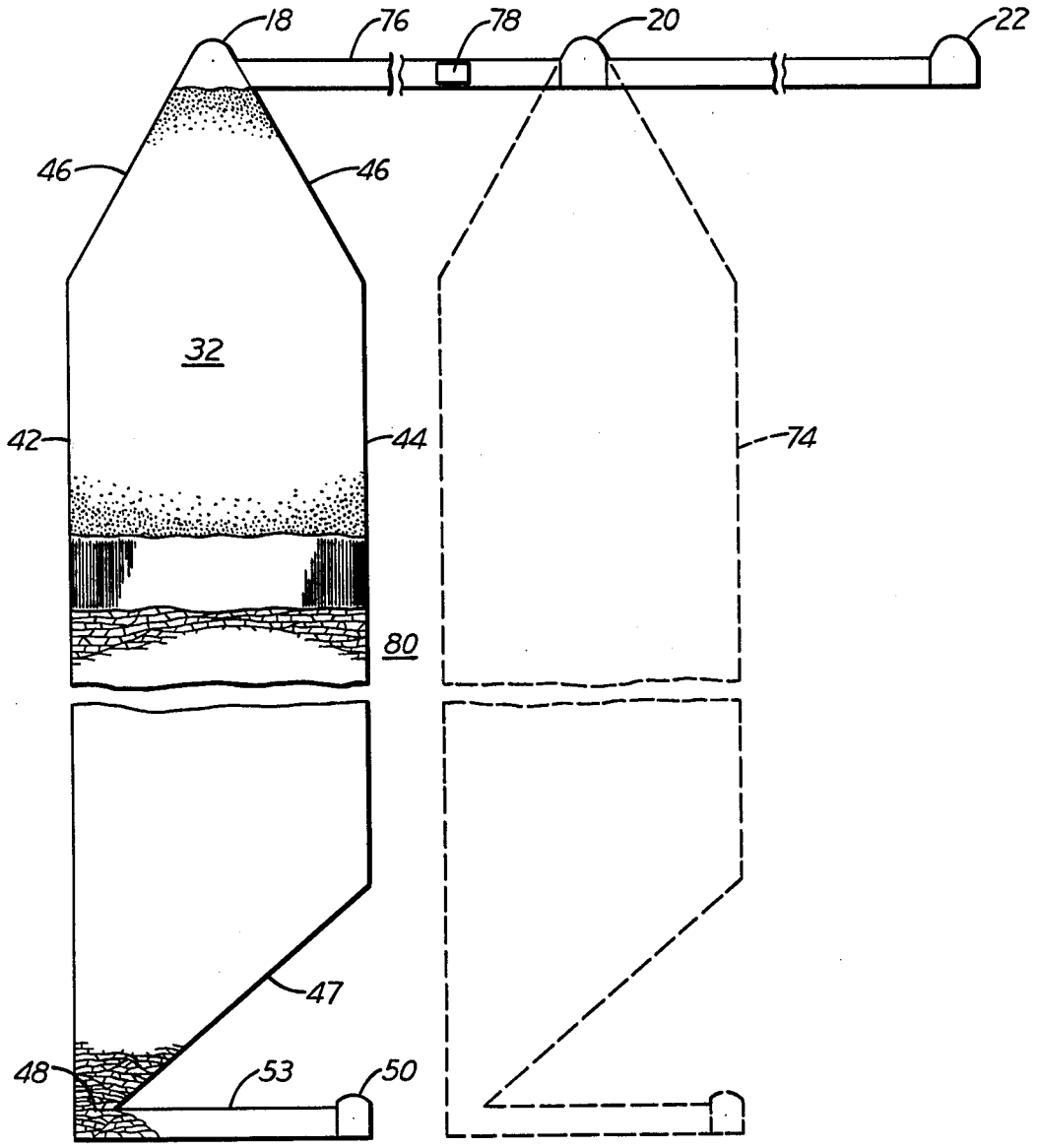
FIG. 3 is a transverse vertical sectional view along section line III—III through a retort in which combustion is occurring.

Referring to FIG. 3, retort 32, to which the other retorts are similar, is shown having vertical sides 42 and 44. Retort 32 has a ceiling 46 sloping upwardly from the upper ends of sides 42 and 44 at an angle exceeding 40° to include the apex drift 18 which forms the apex or crown of the retort that extends the length of the retort. The retort 32 contained rubblized oil shale before ignition of the shale up to a level just below the apex drift 18 leaving free space in the crown of the retort for the distribution of combustion air. Preferably, the apex drift 18 has a ceiling that slopes upwardly at the same angle as ceiling 46 to form a continuation of ceiling 46 when the retort 32 is constructed by rubblization of the shale within the boundaries of the retort. The crown of the apex drift is preferably rounded at its top to minimize concentration of forces that would otherwise exist if the two ceiling walls 46 were extended upwardly until they intersect. The angle of slope of ceiling 46 will depend upon the characteristics of the particular shale deposit. It should not be lower than the maximum angle at which the resulting overhang would be self-supporting if all the shale were removed from the upper end of the retort. Preferably, the slope of the ceiling should be in the range of 45° to 55°. The term "slope" is used to indicate the angle between the ceiling and the horizontal.

Side 42 of retort 32 extends substantially vertically downward to the lower end of the retort. Side 44 is also substantially vertical but extends downwardly only a portion of the way to the lower end of the retort where it meets a sloping bottom 47 that extends from the lower end of side 44 to an outlet 48 at the bottom of the retort. Below the bottom 47 of the retort is an exhaust tunnel 50 that runs for the full length of the row from the retort 38 through the retort 30 and extends downdip beyond retort 30 to intersect a collection tunnel 52. Exhaust tunnel 50 is connected with the outlet of each of the retorts in row A by retort outlet drifts 53 for the delivery of products from the retort into the exhaust tunnel. A remote-controlled door 54 in exhaust tunnel 50 permits isolation of retorts in row A from the collection tunnel 52 after retorting of the shale in the retorts in row A is completed. Collars 56 and 58 for connection with exhaust tunnels from row B and row C, respectively, are driven from the collection tunnel and remote control doors 60 and 62 installed therein prior to initiation of combustion in any of the retorts that deliver products into collection tunnel 52. Collection tunnel 52 is adapted to deliver the products from the retorts into a separator 64 in which liquid products are separated from gaseous products. The liquid products are drained to a pump station 66 from which they are pumped to the surface through pipes in a drift 68. Gaseous products are delivered to the surface through a gaseous products tunnel 70 and shaft 72. Gaseous products may be employed at the surface for the generation of power in apparatus not shown in the drawings.

A future retort 74 in row B is shown in broken lines in FIG. 3 to indicate that the retort has not yet been constructed. It is a feature of this invention that there is no stoping or rubblization proceeding in row B in a retort opposite a retort in row A while combustion is occurring in the row A retort. Retort 74 will extend downwardly from the apex drift 20. That apex drift, like the apex drifts for the other rows of retorts, preferably has sloping upper walls to conform with the sloping ceiling of the retort, continuing upwardly to a rounded top. A plurality of cross drifts 76 connects apex drift 20 with the apex drift 18 in retort 32. A remote-controlled door 78 which may be of the butterfly or damper type, for example, is installed in each of the cross drifts 76 for control of the rate of flow of combustion air into the upper end of retort 32 and isolating the retort after combustion is completed in that retort.

Between the retort 32 and the future retort 74 is a side pillar 80. Pillar 80 extends the full length of the row of retorts. It is a feature of this invention that the pillar 80 extends upwardly from rock, either oil shale or other rock in the event the retorts extend downwardly into base rock, that is not weakened by an underlying retort or tunnels or by penetration by any drifts used in the mining and rubblization of the shale to form the retorts. The exhaust tunnel 50 is under the sloping bottom 46 of the retort and entirely within a projection of the side 44 of the retort. The oil shale below bottom 46 which slopes at an angle preferably of 40° to 50° serves as a buttress to the lower end of pillar 80.

Because retort 74 is not constructed until after combuston is completed in retort 32, pillar 80 has in effect an infinite thickness during the time that the pillar is hottest and consequently weakest. Above the intersection of the side walls of the retorts with the sloping ceiling 46, side pillar 80 increases in thickness to support the overburden above the retort 32. Any weakening of pillar 80 by the cross drifts 76 is minimal and in an area where the pillar has its greatest width and its smallest load. The cross drifts 76 are narrow and occupy only a small fraction of the oil shale over the total length of a retort.

The retorts of this invention have a horizontal length to width ratio of at least 1.5:1 and preferably 2:1 or more to obtain the advantage of increased retort volume in a given length of shale deposit. In a typical installation, the retorts may have a width of 150 feet, a length of 300 feet and a height of 750 feet. Longer retorts can be used but will usually not be desirable because of added difficulity in control of the combustion, greater loss if it should become necessary to abandon a retort, etc. While five retorts are shown in each of the rows, it is expected that in most instances there will be a larger number of retorts in each of the rows. The number will depend on the particular shale deposit developed. Side pillars 80 and end pillars 40 will have a thickness that can range upwardly from about 60 feet, depending upon the strength of the oil shale, the height of the retorts, and the depth of the overburden. It is desirable that the pillars have the minimum thickness that will bear the load on the pillars in order to maximize the amount of oil shale retorted. Usually, the minimum pillar thickness required to provide a stable system will not exceed 120 feet, and rarely will the minimum required thickness exceed 150 feet. End pillars 50 preferably slope inward at their upper end at an angle of approximately 60° with the horizontal as is best shown in FIG. 2 in which the end pillars between specific retorts are given subscripts in addition to the reference numeral 40.

The apex drift 18 preferably slopes downwardly from the combustion air tunnel 16. When the strata of oil shale in the oil shale deposit only dip slightly, for example, less than 10 percent, it is preferred that the apex drift extend directly downdip with the lower ends of the retorts in the lowest stratum of shale that can be economically retorted. That lowest stratum of shale may be determined by the carbonaceous content of the stratum or by geological considerations such as the presence of underlying aquifers that interfere with extending the retorts to lower elevations. Regardless of the slope of the strata in the oil shale deposit, the lower ends of the retorts and the exhaust tunnel 50 should extend downdip from the combustion air tunnel at an angle preferably in the range of 3° to 10° to facilitate the delivery of liquid products to the collection tunnel. While usually the shale will dip away from the combustion tunnel, the term downdip is used to include a direction along the rows of retorts away from the combustion air tunnel regardless of the slope of the shale strata.

In the production of oil from the subsurface oil shale deposit, the apex drift 18 is closed by door **28*a* and apex drifts 22, 24 and 26 are closed by doors 28*c*, 28*d* and 28*e*. Door 28*b* in apex drift 20 is open to allow flow of combustion air from combustion air tunnel 16 into apex drift 20. Cross drifts corresponding to cross drifts 76 will be driven from apex drift 20 to apex drift 18 and from apex drift 20 to apex drift 22 over each of the retorts and projected rotorts in rows A and B before beginning the flow of combustion air into apex drift 20. Each of the cross drifts will include a remote-controlled door similar to door 78. Combustion is first ignited in retort 30, the downdip retort in row A. At the time of ignition of the rubblized oil shale in retort 30, retort 32 is rubblized and is isolated from retort 30 by seals 49 in the mining drifts, seals 51 in the apex drift 18 and doors 82 in the exhaust tunnel 50**.

Rubblized shale in retort 30 is ignited by burning a fuel injected with combustion air from combustion air tunnel 16 delivered through apex drift 20 and cross drifts into the apex drift at the upper end of the retort. After ignition of the shale, the injection of the fuel is discontinued and flow of combustion air into the retort is continued. The combustion front moves downwardly through the retort and hot combustion gases from the combustion front heat the oil shale ahead of or below the combustion front to a temperature high enough to release shale oil. The shale oil drains through the retort outlets into drifts 52 and is delivered through drifts 52 into the exhaust tunnel 50 and then into the collection tunnel.

After combustion of the oil shale is completed in retort 30, a movable remote-controlled door 84 is moved from its original position downstream of the cross drifts delivering air from the apex drift 20 into the retort 30 to the position shown in FIG. 1 in apex drift 20 immediately upstream of those cross drifts. At this time, rubblization of retort 34 will have been completed and that retort is isolated as was retort 32 previously. In FIG. 2, which shows the condition of retorts in row A while combustion proceeds in retort 32, a door 82 is closed between rubblized retort 34 and retort 32 and between rubblized retort 34 and retort 36. A door 82 between retort 32 and retort 30 is open to allow products of retorting to flow through the exhaust tunnel 50. Doors 82 have not yet been installed between retort 36 and retort 38. Oil shale in the upper end of retort 32 is ignited and the combustion of shale in that retort is continued. Valves 78 in cross drifts 76 are adjusted as required to control the progress of the combustion in retort 32. The sequence is repeated, progressing updip until retorting of oil shale in all of the retorts in row A is completed. While the invention has been described with reference to conducting the combustion of oil shale in a single retort in a row at any one time, that is down only for convenience in description of the invention. It is desirable that combustion proceed continuously, and if interruptions of the combustion process are to be avoided, combustion will often proceed in more than one retort in a row. In longer rows that include a large number of retorts, combustion may proceed in three or more retorts simultaneously to produce shale oil at the desired rate. It will be necessary that rubblization proceed far enough in advance of the combustion that rubblization is completed in any retort before ignition of oil shale in the adjacent downdip retort.

Figure 4:
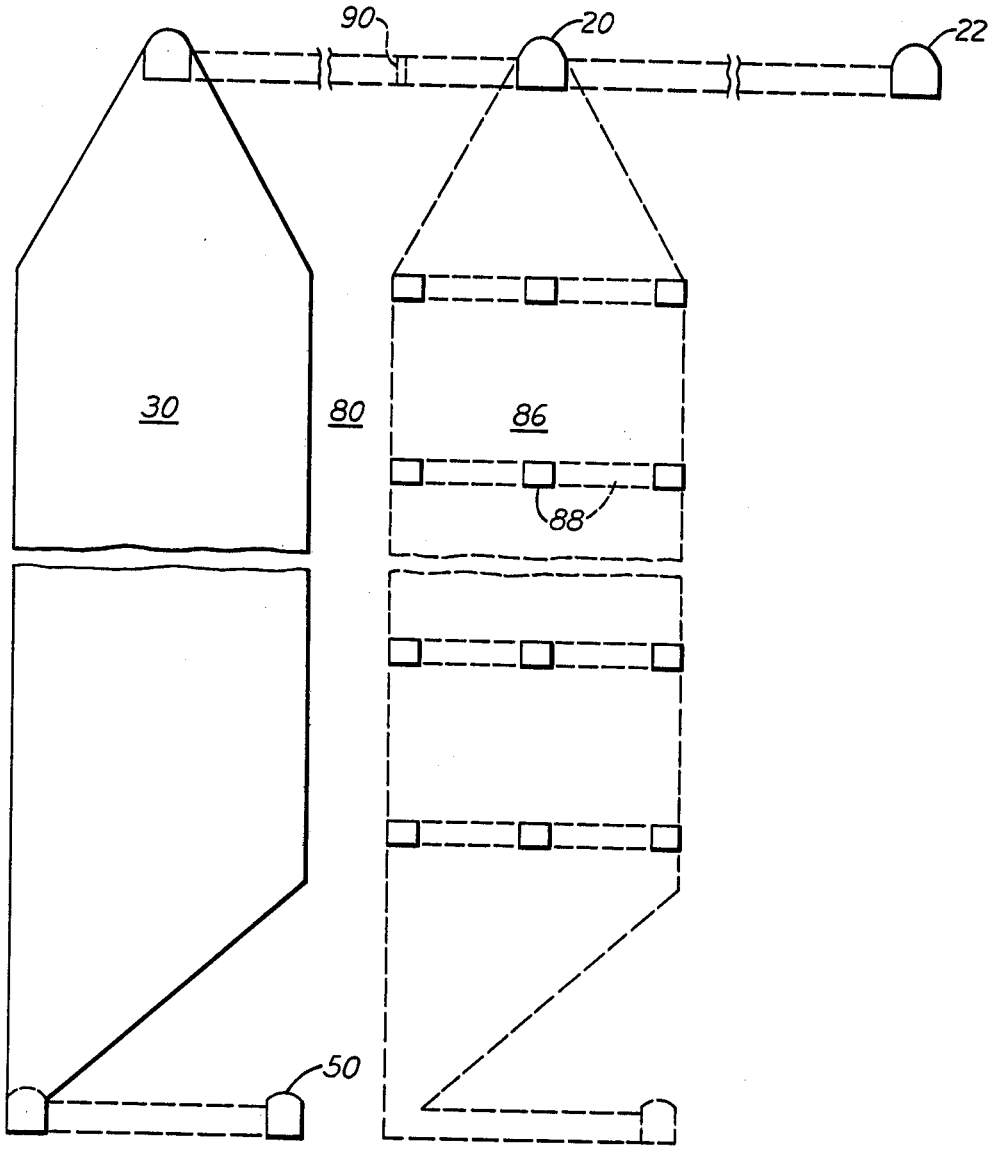
FIG. 4 is a transverse sectional view along section line IV—IV in FIG. 1.

The closing of the door 84 isolates the downdip end of apex drift 20 to allow stoping and rubblization to proceed in the downdip retort 86 in row B. Retort 86 is illustrated in FIG. 4 in the initial stages of construction in which mining drifts 88 have been driven. It is an important feature of this invention that while mining drifts 88, and the mining drifts 47 shown in FIG. 2 in the retorts in row A, penetrate end pillars between adjacent retorts in a row, they do not at any time penetrate the side pillars. Retort 30 is isolated from the construction of the retort 86 by remote-controlled adjustable doors 90, similar to doors 78, which are closed upon completion of the combustion in retort 30. The sequence of stoping, rubblization, burning and isolation of retorts proceeding progressively updip is repeated in all of the rows and proceeds successively from one row to the adjacent row.

The retorting system of this invention utilizing parallel rows of retorts of elongated rectangular cross section and having a ceiling sloping upwardly from both sides to a central apex drift forming the crown of the retorts allows retorting of a maximum amount of the shale in the oil shale deposit. As an example of the advantages of the elongated angular retorts of this invention, suppose the maximum permissible span across the top of the retorts is 150 feet. If the retorts were square, it would be necessary for retorting a linear run of 1500 feet of the oil shale to use 10 retorts in a row. Those retorts will be separated by nine end pillars. If the end pillars are 100 feet in width, the total length of the rows or retorts will be 2400 feet. In contrast, if the retorts were of rectangular section and were 300 feet long, only five retorts would be required for retorting 1500 feet of the shale deposit. Those retorts would be separated by four end pillars and the total length of the row would be only 1900 feet, leaving 400 feet of shale available for the construction of additional retorts.

The rows of retorts are separated by side pillars that are not penetrated by any of the drifts used in the construction of the retorts; hence, are not weakened. More-over, the pillars are supported by oil shale or base rock that is not undermined by tunnels or retorts. The sloping ceiling of the retorts increases the stability of the ceiling and increases the width of the retorts that is permissible and will support the overburden. In the preferred arrangement in which combustion air is supplied to the retorts through cross drifts opening into the crown of the rotorts, the increased thickness of the pillars at the level of the cross drifts and the relatively small load on the pillars compared to the load near their base give a strong, stable structure. The open space through the apex drifts forming the elongated crown extending the full length of the retorts gives uniform distribution of combustion air to the retort.

We claim:

1. A method for producing a fluid fuel from subsurface deposits of carbonaceous material comprising driving a plurality of substantially parallel, spaced-apart apex drifts from a combustion air supply tunnel, constructing a row of rubblized retorts under each of the apex drifts whereby the apex drifts form the crown of the retorts and the rows of retorts are separated by side pillars, said retorts having a rectangular horizontal cross section with the ratio of length to width being at least 1.5:1 and being arranged end-to-end in the row with the retorts separated from adjacent retorts in the row by end pillars, said retorts having a ceiling sloping upward at an angle with the horizontal greater than 40 degrees from each of the sides to the apex drift, barricading the apex drift in each of the end pillars to isolate the retorts from one another, said retorts having a bottom sloping downwardly to an outlet at the lower end of the retort, driving an exhaust tunnel communicating with the outlet below the sloping bottom of the retorts in the row beyond the end of the row to a collection tunnel, injecting combustion air into the apex drift of the retorts and igniting the carbonaceous material at the upper end thereof to burn carbonaceous material in the retort, continuing the injection of combustion air to move the combustion front downwardly through the retort to liberate a fluid fuel from the carbonaceous material, and delivering products of the retorting through the outlet to the exhaust tunnel for delivery to the collection tunnel and the surface.

2. A method as set forth in claim 1 characterized by the bottom of the retort sloping downwardly from the lower end of one side to the outlet and the outlet being at the lower end of the opposite side.

3. A method as set forth in claim 1 in which the slope of the ceiling is between 45 degrees and 55 degrees.

4. A method as set forth in claim 1 characterized by driving a cross drift from an apex drift adjacent to a row of retorts prior to ignition of the carbonaceous material in the row of retorts and supplying combustion air from the adjacent apex drift through the cross drift into the apex drift at the top of the retorts.

5. A method as set forth in claim 1 characterized by igniting the carbonaceous material in the retorts in a row progressively beginning at the retort farthest from the combustion air supply tunnel and discontinuing flow of combustion air into each of the retorts on completion of combustion in the retort.

6. A method as set forth in claim 3 characterized by igniting the carbonaceous material in the retorts in a row progressively beginning at the retort farthest from the combustion air tunnel and discontinuing flow of combustion air into the retorts on completion of combustion in a retort.

7. A method as set forth in claim 1 characterized by the retorts having a width of 100 to 175 feet and the side pillar between adjacent rows of retorts having a width of 60 to 125 feet.

8. A method as set forth in claim 1 characterized by constructing the ceiling of the retorts to slope upwardly from the ends of the retorts at an angle of at least 60°.

9. A method as set forth in claim 1 characterized by driving the apex drifts downdip from the combustion air tunnel, constructing the retorts with the outlet from each retort in a row lower than the outlets of retorts in the row closer to the combustion tunnel, and burning carbonaceous material in the retorts progressively from the retort having the lowest outlet to the retort having the highest outlet.

10. A method as set forth in claim 4 characterized by following combustion in a retort in the row with the construction of a retort opposite said retort in which combustion is completed in the row under the adjacent apex drift.

11. A method as set forth in any of claims 1, 2, 3, 4, 7, 9 or 10 in which the deposit is oil shale.

12. A method as set forth in claim 1 in which the deposit is coal.

13. A method as set forth in claim 1 in which the deposit is a tar sand.

14. A retorting system for the recovery of a fluid fuel from a subsurface deposit of a carbonaceous material by burning a portion of the carbonaceous material comprising a combustion air tunnel extending through the deposit and communicating with a source of compressed air, a plurality of spaced-apart, substantially parallel apex drifts extending from the combustion air tunnel, a row of rubblized retorts under each of the apex drifts with the upper end of each retort in the row opening into the apex drift, said retorts having an elongated, rectangular horizontal cross secton with the length at least one and one-half times the width and being arranged end-to-end, end pillars between adjacent retorts in the row, sealing means in the apex drift between adjacent retorts in a row separating the retorts, said retorts having a ceiling sloping upwardly at an angle of at least 40 degrees from opposite sides thereof to the apex drift, the retorts having a bottom sloping downwardly from the lower end of one side to a retort outlet adjacent the lower end of the opposite side, an exhaust tunnel communicating with the outlet extending below the bottom of all the retorts in a row to an outlet tunnel and communicating with the outlets of each of the retorts, cross drifts connecting adjacent apex drifts and opening into each of the retorts, means for controlling the flow of combustion air through the cross drifts to control combustion of oil shale in the retorts, and an unbroken side pillar supported by undisturbed oil shale extending upwardly between adjacent rows to support the overburden, said side pillar being unbroken below the cross drifts.

15. A system as set forth in claim 14 characterized by the deposit being oil shale.

16. A system as set forth in claim 14 characterized by the deposit being a tar sand.

17. A system as set forth in claim 14 characterized by the deposit being coal.

* * * * *